United States Patent [19]

Freiburger

[11] 4,019,717

[45] Apr. 26, 1977

[54] WINCH CABLE DRUM MOUNTING AND DRIVE CONNECTION

[75] Inventor: Thomas William Freiburger, Dubuque, Iowa

[73] Assignee: Deere & Company, Moline, Ill.

[22] Filed: May 5, 1975

[21] Appl. No.: 574,556

[52] U.S. Cl. ..... 254/187.8; 254/150 R

[51] Int. Cl.[2] ..... B66D 1/00

[58] Field of Search ..... 254/187 C, 187 R, 187 H, 254/181, 186 R, 150 R

[56] References Cited

UNITED STATES PATENTS 3,107,899 10/1963 Henneman ..... 254/187 H

*Primary Examiner*—Robert J. Spar
*Assistant Examiner*—Donald W. Underwood

[57] ABSTRACT

A winch includes a housing including spaced apart first, second and third upright wall portions. The second and third wall portions form part of an enclosure in which a drive train is located, the latter including an output shaft rotatably mounted in the second and third wall portions, the output shaft has an end portion projecting axially into and terminating within a hollow cable drum that is located between the first and second wall portions, the drum having one end rotatably mounted in the first wall portion and having its other end rotatably mounted on the output shaft. A free spool clutch is provided which is normally in a condition establishing a drive connection between the output shaft and the cable drum but is selectively actuatable to establish a free spool condition wherein the drum is disconnected from the drive train.

6 Claims, 1 Drawing Figure

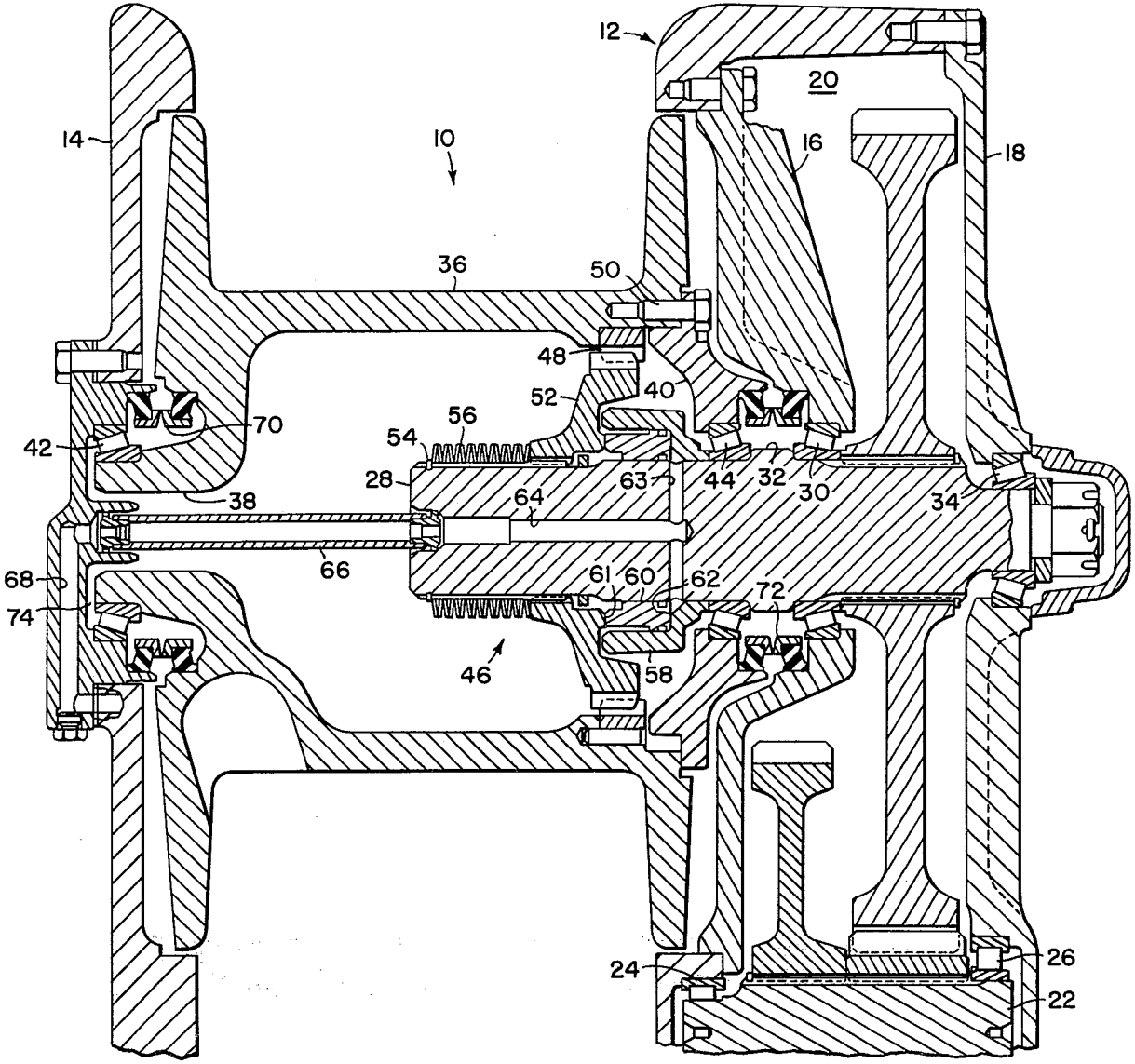
10
12
14
16
18
20
22
24
26
28
30
32
34
36
38
40
42
44
46
48
50
52
54
56
58
60
61
62
63
64
66
68
70
72
74

WINCH CABLE DRUM MOUNTING AND DRIVE CONNECTION

BACKGROUND OF THE INVENTION

The present invention relates to a winch assembly of the type employable in logging or towing applications and more particularly relates to a cable drum mounting and drive connection of such an assembly.

Winches available for use with logging vehicles and the like normally include one or more clutches embodied in the drive trains of the winches and selectively operable to disconnect the drive input shaft from a cable drum of the winch so as to establish a free spool condition. Heretofore, these winches have not been entirely satisfactory since in some constructions a considerable portion of the drive train remains connected to the drum during the free spool condition and thus creates an undesirable drag on free drum movement and in other constructions reaction forces from the clutch for disconnecting the drum from the power train are transferred to the drum and again result in an undesirable drag force being imposed on the drum.

SUMMARY OF THE INVENTION

According to the present invention there is provided a winch assembly including a hollow cable drum having its opposite ends respectively mounted in a housing wall portion and on a drive train output shaft extending axially into the drum; and there is provided a hydraulically operated normally engaged free spool clutch which is selectively disengageable to disconnect the drive connection between the output shaft and the drum.

It is a broad object of the invention to so mount the cable drum and free spool clutch that the clutch may be selectively operated to entirely disengage the cable drum from the drive train without any reaction forces being transferred to the drum so as to establish a free spool condition wherein the drum is substantially free from drag.

Another object of the invention is to provide means for efficiently and effectively conveying operating fluid to the clutch.

These and other objects will become apparent from reading the ensuing description in conjunction with the appended drawing.

BRIEF DESCRIPTION OF THE DRAWING

The sole FIGURE is a sectional view showing an upper portion of a winch assembly having the present invention embodied therein.

DESCRIPTION OF THE PREFERRED EMBODIMENT

Referring now to the drawing, there is shown an upper part of a winch indicated in its entirety by the reference numeral 10. The winch 10 includes a housing 12 including first, second and third upright wall portions 14, 16 and 18, respectively, as viewed from left to right. The wall portions 16 and 18 form part of a fluid tight cavity or enclosure 20 in which is located the drive or power train of the winch 10. Only a final part of the drive train is shown and it includes a countershaft 22 rotatably mounted in the wall portions 16 and 18 respectively through means of a pair of bearings 24 and 26 mounted on the opposite ends thereof; and an output shaft 28 which projects through the wall portion

16 above the countershaft 22 and is rotatably mounted in the wall portions 16 and 18 respectively through means of a bearing 30, mounted on the shaft 28 against the right face of an annular shoulder 32 formed on the shaft 28 approximately midway between the opposite ends thereof, and a bearing 34 mounted on the right end of the shaft 28.

That portion of the output shaft 28 which is located outside of the cavity 20 projects axially into the right end of a hollow, open-ended cable drum 36 located between the wall portions 14 and 16 and having reduced left and right end portions 38 and 40 respectively rotatably mounted in the wall portion 14 and on the shaft 28 respectively through means of a bearing 42 located on the exterior of the portion 38 and a bearing 44 located inside the portion 40 and against the left face of the shoulder 32 of the shaft 28.

A normally engaged free spool clutch 46 is provided for selectively disconnecting a drive connection between the output shaft 28 and the cable drum 36. The clutch 46 is in the form of a gear clutch and includes a first gear element in the form of an internal annular spur gear 48 fixed inside the drum 36 adjacent the end portion 40 thereof, the end portion 40 being detachably secured to the remainder of the drum 36, through means of cap screws 50, so as to permit installation and removal of the gear 48. The clutch 46 further includes a second gear element in the form of a spur gear 52 splined for rotation with and for axial movement along the shaft 28. The left end of the shaft 28 terminates generally centrally within the drum 36 and located between a snap ring 54, mounted on the shaft 28 adjacent the left end thereof, and the left end of the gear 52 is a stack of Belleville washers 56 which are arranged to normally bias the gear 52 to a rightward location, as illustrated, wherein it is meshed with the gear 48.

Provision is made for hydraulically shifting the gear 52 leftwardly to disengage it from the gear 48 to thereby establish a free spool condition wherein the drum 36 is free from the drive train of the winch 10. Specifically, an annular leftwardly opening cylinder 58 is fixed on the shaft 28 with its right end engaged with the inner race of the bearing 44. An annular piston 60 is positioned in the cylinder 58 with its opposite ends normally being in engagement with a rightwardly facing surface 61 of the gear 52 and an end wall 62 of the cylinder 58. Operating fluid for actuating the piston 60 is routed to the right side of the latter through means of radial passages 63 in the shaft 28 which branch from a passage 64 which extends axially in the shaft 28 to the left end thereof whereat it communicates with the right end of an open-ended quill tube 66 having its opposite ends mounted in the shaft 28 and wall portion 14. A passage 68 in the wall portion 14 communicates with the left end of the quill tube 66, and is adapted to be connected to a control valve (not shown) for selectively connecting the passage 68 to a source of fluid pressure or to a sump.

While not forming a part of the present invention, it is to be noted that the hollow interior of the drum 36 serves to convey lubrication fluid for the various bearings of the winch 10 and for the purpose of keeping this fluid from leaking between the drum 36 and the wall portions 14 and 16 of the housing 12 there are provided a pair of face seal assemblies 70 and 72 respectively located annularly outwardly of the bearing 42 and annularly outwardly of and between the bearings 44 and 30. A lubrication fluid supply passage (not shown) is located in the wall portion 14 and communicates with a space 74 between the left end portion 38 of the drum 36 and the wall portion 14 at a level just below the quill tube 66. Thus, it will be appreciated that lubrication fluid will fill the drum 36 to a level at least as high as the bearings 44 and 30 and will keep the bearings 42, 44 and 30 bathed in the fluid. Fluid which passes through the bearing 30 will gravitate to lubricate bearings located therebelow and will contact gears which will throw or carry the fluid to other bearings including the bearing 34.

In operation, the gear clutch 46 is normally engaged as illustrated, so that the drum 36 is rotated whenever the output shaft 28 is rotated. A free spool condition may then be established in the winch by introducing pressure fluid into the left end of the cylinder 58 through actuation of a control valve (not shown) as is conventional. The pressure fluid will shift the piston 60 leftwardly in the cylinder 58, the piston 60 concurrently effecting leftward movement of the gear 52 against the Belleville washers 56 so as to disengage the gear 52 from the gear 48.

Of importance is the fact that the Belleville washers 56, cylinder 58, and piston 60 are mounted on the shaft 28 such that the forces generated by the washers 56 and the fluid acting on the piston 60 are transferred directly into the shaft 28 at the snap ring 54 and the shoulder 32, the forces at these locations being equal in magnitude and opposite in direction. Thus, none of the forces associated with the actuation of the gear clutch 46 are transferred to the drum 36 or the bearings associated therewith.

Also of importance is the fact that the output shaft 28 is relatively short and terminates within the drum 36 thus making it quite easy to supply operating fluid to the piston 60 through means of the quill tube 66. If the shaft 28 extended completely through the drum 36, it is clear that more material would be required for its manufacture and that another bearing would be required to support the shaft 28.

I claim:

1. In a winch of the type including a housing, a drive train mounted in the housing and including an output shaft at its terminus, a hollow winch drum mounted for rotation about a fixed axis coaxial with said output shaft and having said output shaft extending thereinto, a clutch means including a first clutch element axially shiftably mounted on said output shaft, a biasing means normally urging said first clutch element to a first location on said output shaft, a second clutch element fixed to said drum so as to be engaged with said first clutch element for being driven by the latter when it is in said first location, and actuator means for selectively shifting said first clutch element in opposition to the biasing means to a second location on said shaft wherein the first clutch element is disengaged from the second clutch element, an improved mounting for the winch drum and output shaft, comprising: first and second bearing means respectively mounting opposite first and second ends of the winch drum for rotation in a first wall of the housing and for rotation on the output shaft; third and fourth bearing means respectively mounting said output shaft for rotation in second and third walls of said housing; said second bearing means being mounted on the output shaft between, and in direct engagement with, a shoulder of the output shaft and with the actuator means; and said actuator means being supported on the output shaft for concurrent action against the first clutch element and reaction against the second bearing means during shifting of the first clutch element to its second location, whereby the winch drum may be disengaged from being driven by the output shaft without reaction forces from the clutch means being transferred thereto.

2. The winch defined in claim 1 wherein said output shaft has an end located within said drum and said biasing means being mounted on the output shaft adjacent said last mentioned end.

3. The winch defined in claim 2 wherein said biasing means includes a stack of Belleville washers comprising a plurality of oppositely facing pairs of the washers; and said washers being mounted on the output shaft between a snap ring carried by the output shaft, adjacent said end thereof located within said drum, and said first clutch element.

4. The winch defined in claim 1 wherein said actuator means includes an annular piston axially shiftably mounted on the output shaft and received in a cylinder defined by a collar mounted on the output shaft between the first clutch element and the second bearing means and engaged with the latter; said cylinder opening towards the first clutch element; and said piston having an end engaged with said first clutch element.

5. The winch defined in claim 4 wherein fluid for actuating the piston is routed thereto by means of a tubular conduit having its opposite ends respectively mounted in the first wall of the housing and in an end of said output shaft, which is located in the drum in spaced relationships to the first wall, by means of a bore means in said output shaft means which extends from the conduit means to a location between the piston and collar.

6. A winch comprising: a housing; a drive train mounted in said housing and including an output shaft rotatably mounted in adjacent first and second walls of the housing; a hollow cable drum located between a third and the second wall of said housing and having an end of said output shaft terminating therewithin; said drum having opposite ends respectively rotatably mounted in said third wall and on said output shaft; clutch means normally establishing a driving connection between the output shaft and the drum and including a first toothed clutch element axially shiftably mounted on a portion of the output shaft located within the drum; a biasing means mounted on the output shaft between the terminal end thereof and the first toothed clutch element and normally acting against the latter to position it in a first location; a second toothed clutch element fixed to the drum and being engaged with the first toothed clutch element when the latter is in said first location; an actuator means including an actuating element shiftably mounted on said output shaft for moving the first toothed clutch element in opposition to said biasing means to a second location wherein the first and second toothed elements are disengaged from each other; and said actuator means including reaction force transferring means acting against said output shaft when the actuator means is actuated, whereby reaction forces imposed on said output shaft respectively by said biasing means and said actuating means during actuation of the latter balance each other resulting in no forces being transferred to the winch drum as a result of disengagement of the clutch means so as to permit free spooling of the drum.

* * * * *